US010960243B2

(12) United States Patent
Chen et al.

(10) Patent No.: US 10,960,243 B2
(45) Date of Patent: Mar. 30, 2021

(54) FALL ARREST DEVICE

(71) Applicant: YOKE INDUSTRIAL CORP., Taichung (TW)

(72) Inventors: Feng-Wei Chen, Taichung (TW); Wei-Chieh Hung, Taichung (TW)

(73) Assignee: YOKE INDUSTRIAL CORP., Taichung (TW)

( * ) Notice: Subject to any disclaimer, the term of this patent is extended or adjusted under 35 U.S.C. 154(b) by 132 days.

(21) Appl. No.: 16/195,317

(22) Filed: Nov. 19, 2018

(65) Prior Publication Data

US 2020/0078621 A1 Mar. 12, 2020

(30) Foreign Application Priority Data

Sep. 11, 2018 (TW) ..... 107131911

(51) Int. Cl.

| | |
|---|---|
| ***A62B 35/00*** | (2006.01) |
| ***B65H 75/48*** | (2006.01) |
| ***B65H 75/40*** | (2006.01) |
| ***B65H 75/44*** | (2006.01) |
| ***A62B 1/10*** | (2006.01) |

(52) U.S. Cl.

CPC ..... *A62B 35/0093* (2013.01); *A62B 1/10* (2013.01); *B65H 75/40* (2013.01); *B65H 75/4428* (2013.01); *B65H 75/486* (2013.01)

(58) Field of Classification Search

CPC ..... A62B 1/08; A62B 1/10; A62B 35/0093; B65H 75/4428

See application file for complete search history.

(56) References Cited

U.S. PATENT DOCUMENTS 3,760,910 A * 9/1973 Koshihara ..... F16D 59/00 188/180
4,877,110 A * 10/1989 Wolner ..... A62B 35/0093 182/232
5,186,289 A * 2/1993 Wolner ..... A62B 1/12 182/232
5,343,976 A * 9/1994 Ostrobrod ..... A62B 1/06 182/237

(Continued)

FOREIGN PATENT DOCUMENTS

EP 0687482 A2 * 12/1995 ..... A62B 35/0093
GB 2543366 A * 4/2017 ..... A62B 35/0093

*Primary Examiner* — Colleen M Chavchavadze
(74) *Attorney, Agent, or Firm* — Tracy M. Heims; Apex Juris, pllc.

(57) ABSTRACT

A fall arrest device includes a bracket, a rotating member rotatably mounted to the bracket, a safety belt wound around the rotating member, a brake wheel connected to the rotating member, a brake block pivotally connected to the brake wheel, and a restoring spring fitting around the second segment and having one end thereof terminating in a ring that has an inner diameter smaller than an outer diameter of the first segment. Another end of the restoring spring is connected to the brake block. The brake wheel has a fixed rod having a first segment and a second segment. An outer diameter of the first segment is greater than an outer diameter of the second segment. The restoring spring urges the brake block to be located in a restoring position. Thus, the restoring spring could be prevented from falling out of the fixing rod.

13 Claims, 8 Drawing Sheets

(56) References Cited

U.S. PATENT DOCUMENTS

| | | | | |
|---|---|---|---|---|
| 8,181,744 | B2 * | 5/2012 | Parker | A62B 1/10 182/232 |
| 9,573,564 | B2 * | 2/2017 | Boyer | A62B 1/10 |
| 9,861,841 | B1 * | 1/2018 | Hung | A62B 35/0093 |
| 10,020,720 | B2 * | 7/2018 | Diehl | A63G 21/22 |
| 10,576,310 | B2 * | 3/2020 | Hung | A62B 35/0093 |
| 2017/0338728 | A1 * | 11/2017 | Diehl | B60R 22/36 |
| 2019/0256320 | A1 * | 8/2019 | Hinojosa | H02G 11/02 |

* cited by examiner

FALL ARREST DEVICE

BACKGROUND OF THE INVENTION

Field of the Invention

The present invention relates to fall protection technology, and more particularly to a fall arrest device that is practical for use in a hanging work site.

Description of the Related Art

When working at height, people will be equipped with a fall arrest device containing a safety belt. The fall arrest device is fixed to a support, and the safety belt is attached to the person to prevent the person from falling, thus ensuring personnel safety.

FIG. 1 illustrates a conventional fall arrest device 1, which comprises a housing 10, and a bracket 12 a rotating member 14, a safety belt 16, a winding device 18, a brake wheel 20, and two brake blocks 22 respectively mounted in the housing 10. The housing 10 is made up of two shells 102. The bracket 12 has a first side panel 122 and a second side panel 124 facing each other. The rotating member 14 is rotatably mounted between the first side panel 122 and the second side panel 124. The first side panel 122 is provided with a stopper 122*a*. The safety belt 16 is wound around the rotating member 14. The reeling device 18 is disposed on an outer side of the second side panel 124 and has a spiral spring 182 connected to the rotating member 14 for providing a force to rewind the safety belt 16. The brake wheel 20 is disposed on an outer side of the first side panel 122 and is joined to and is rotated with the rotating member 14. The brake wheel 20 has an outer surface 202 facing away from the first side panel 122. The brake block 22 is pivotally mounted to a pivot axle 202*a* disposed on the outer surface 202 of the brake wheel 20. Further, the brake block 22 is disposed between the housing 10 and the first side panel 122. When the user accidentally falls, the safety belt 16 drives the rotating member 14 to rotate rapidly, and the brake block 22 is forced by the centrifugal force generated during rotation of the brake wheel 20 to pivot from a restoring position to an extended position where the brake block 22 abuts against the stopper 122*a* to restrict the rotation of the rotating member 14, thereby to stop the rotating member 14 from rotation and to prevent the user from falling continuously.

In order to urge the brake block 22 normally stay at the restoring position, a restoring spring 24 is connected between the brake wheel 20, and the brake block 22. An end of the restoring spring 24 fits around a fixing rod 202*b* of the brake wheel 20. However, when the user is working, the fall arrest device 1 may be shaken. If the restoring spring 24 disengages from of the fixing rod 202*b*, the brake block 22 will be shaken, and the brake block 22 could be stuck on the stopper 122*a*, so that the safety belt 16 could not be pulled out. Even worse, the brake block 22 could be disengaged from the pivot axle 202*a*, losing its safety locking effect.

SUMMARY OF THE INVENTION

The present invention has been accomplished under the circumstances in view. It is the main object of the present invention to provide a fall arrest device, which prevents the restoring spring from disengaging from the fixing rod to increase the reliability of the fall arrest device.

To achieve this and other objects of the present invention, a fall arrest device comprises a bracket, a rotating member, a safety belt, a brake wheel, a brake block, and a restoring spring. The bracket has a stopper provided thereon. The rotating member is rotatably disposed on the bracket. The safety belt is wound around the rotating member and is pulled to drive the rotating member to rotate. The brake wheel is connected to and is rotated with the rotating member. The brake block is pivotally disposed on the brake wheel, and has a stop portion. The restoring spring has a first end thereof connected to the brake wheel, and a second end thereof connected to the brake block. The restoring spring normally drives the brake block to remain in a restoring position. The stop portion of the brake block is spun out with a centrifugal force generated by a rotation of the brake wheel to abut against the stopper so as to limit a rotation of the rotating member. The fall arrest device is characterized in that the brake wheel includes a wheel body and a fixing rod. The wheel body is connected to the rotating member. The fixing rod has a fixed end, a first segment, and a second segment. The fixed end is connected to the wheel body. The second segment is located between the fixed end and the first segment. Further, an outer diameter of the first segment is greater than an outer diameter of the second segment. The first end of the restoring spring has a ring fitting around the second segment of the fixing rod. An inner diameter of the ring is smaller than the outer diameter of the first segment.

Since the outer diameter of the outer diameter of the first segment of the fixing rod is greater than the inner diameter of the ring of the restoring spring, the ring could be restricted to the second segment, effectively avoiding the restoring spring from disengaging from the fixing rod.

BRIEF DESCRIPTION OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
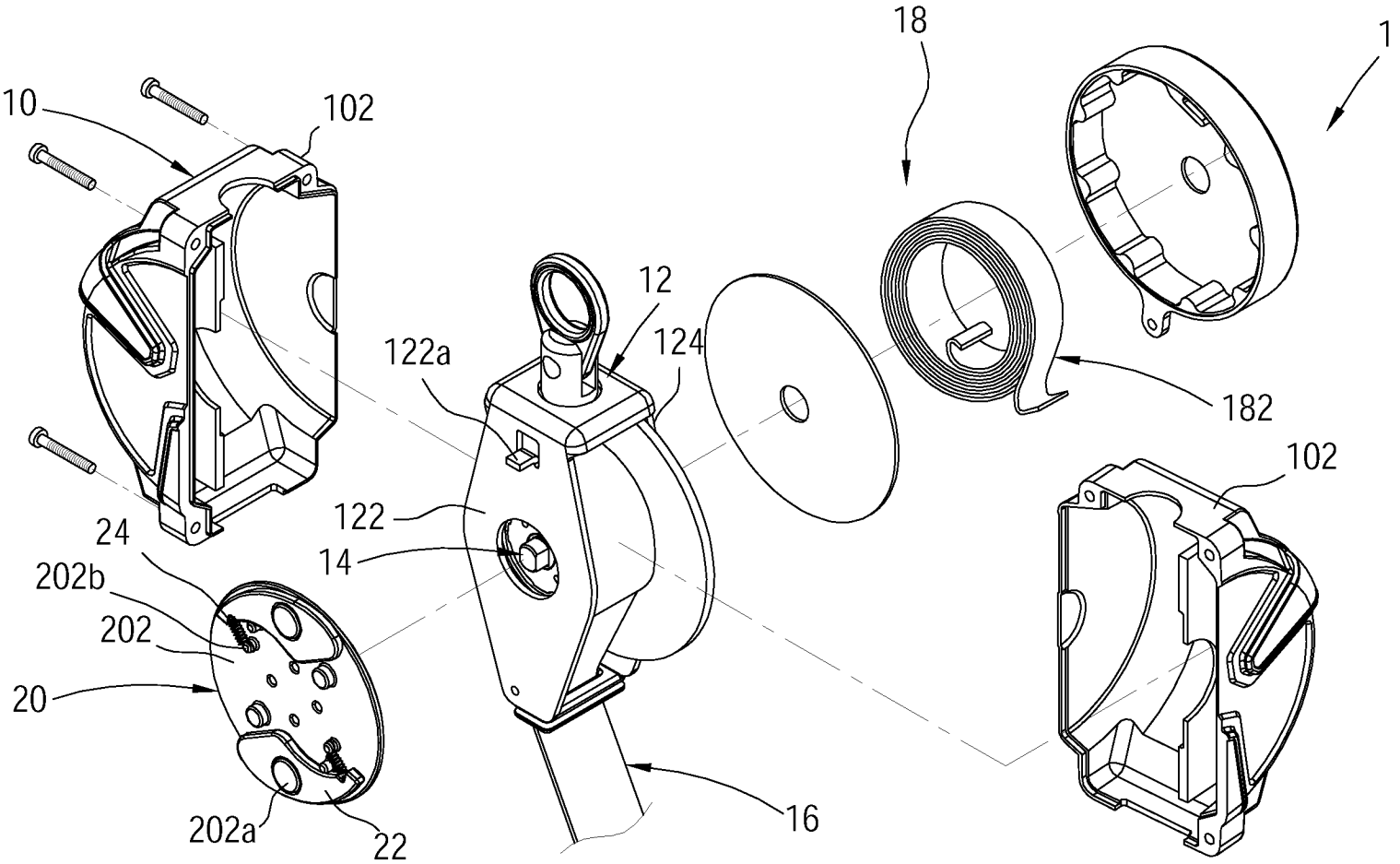
FIG. 1 (PRIOR ART)
FIG. 1 is an exploded view of a conventional fall arrest device.
Figure 2:
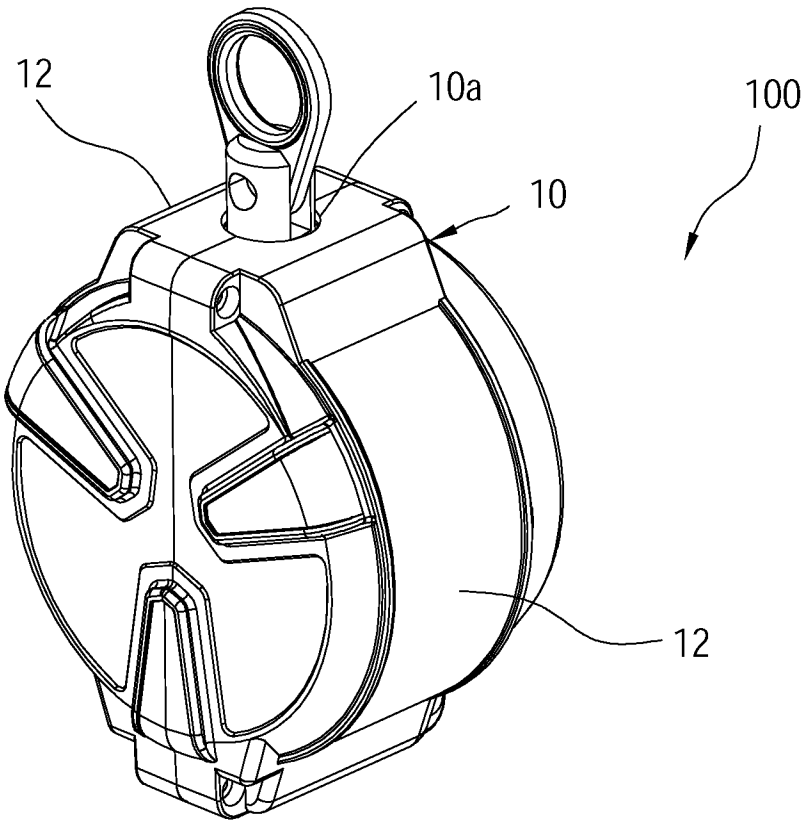
FIG. 2 is a perspective view of the fall arrest device in accordance with a first embodiment of the present invention.
Figure 3:
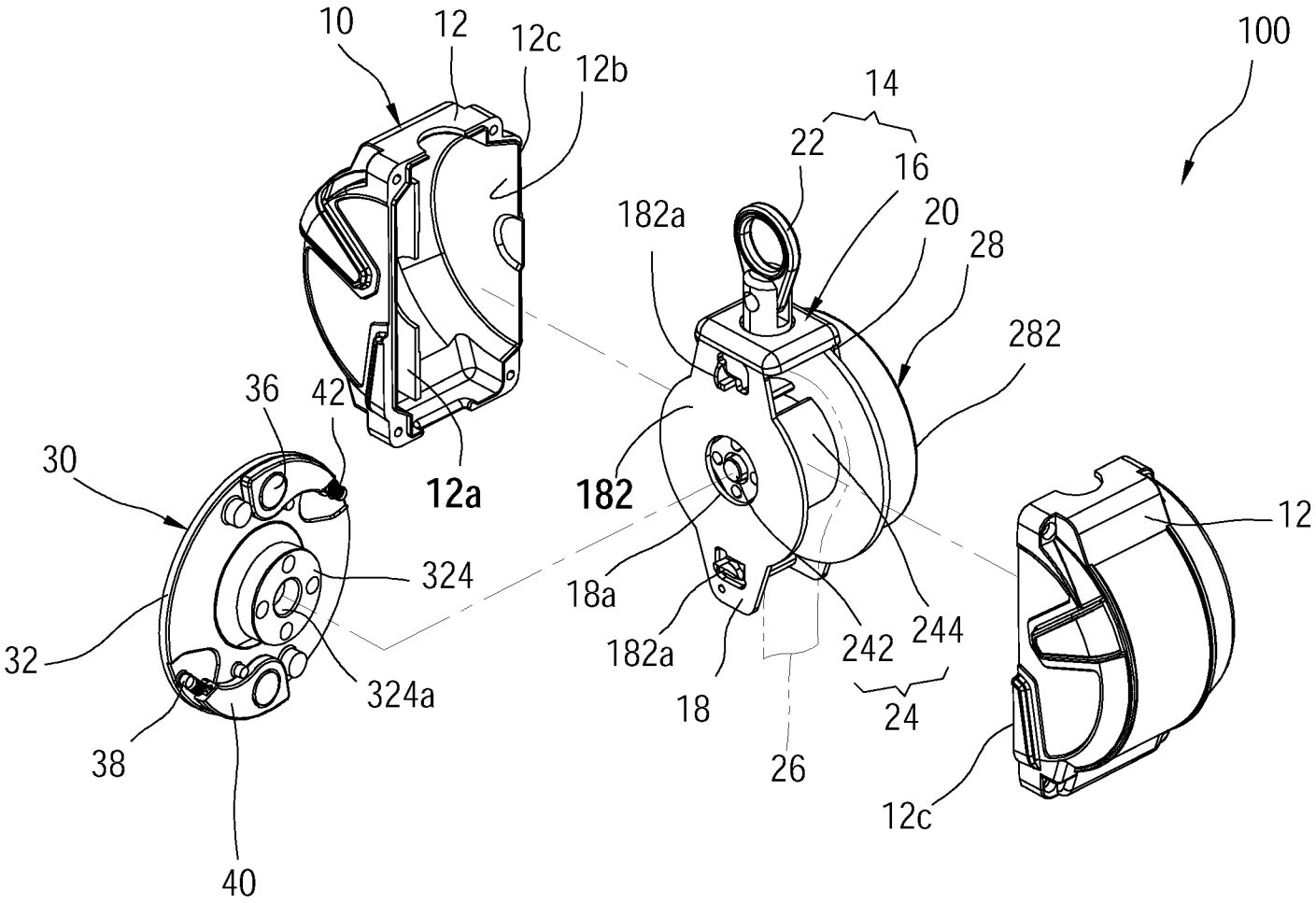
FIG. 3 is an exploded view of the fall arrest device in accordance with the first embodiment of the present invention.
Figure 4:
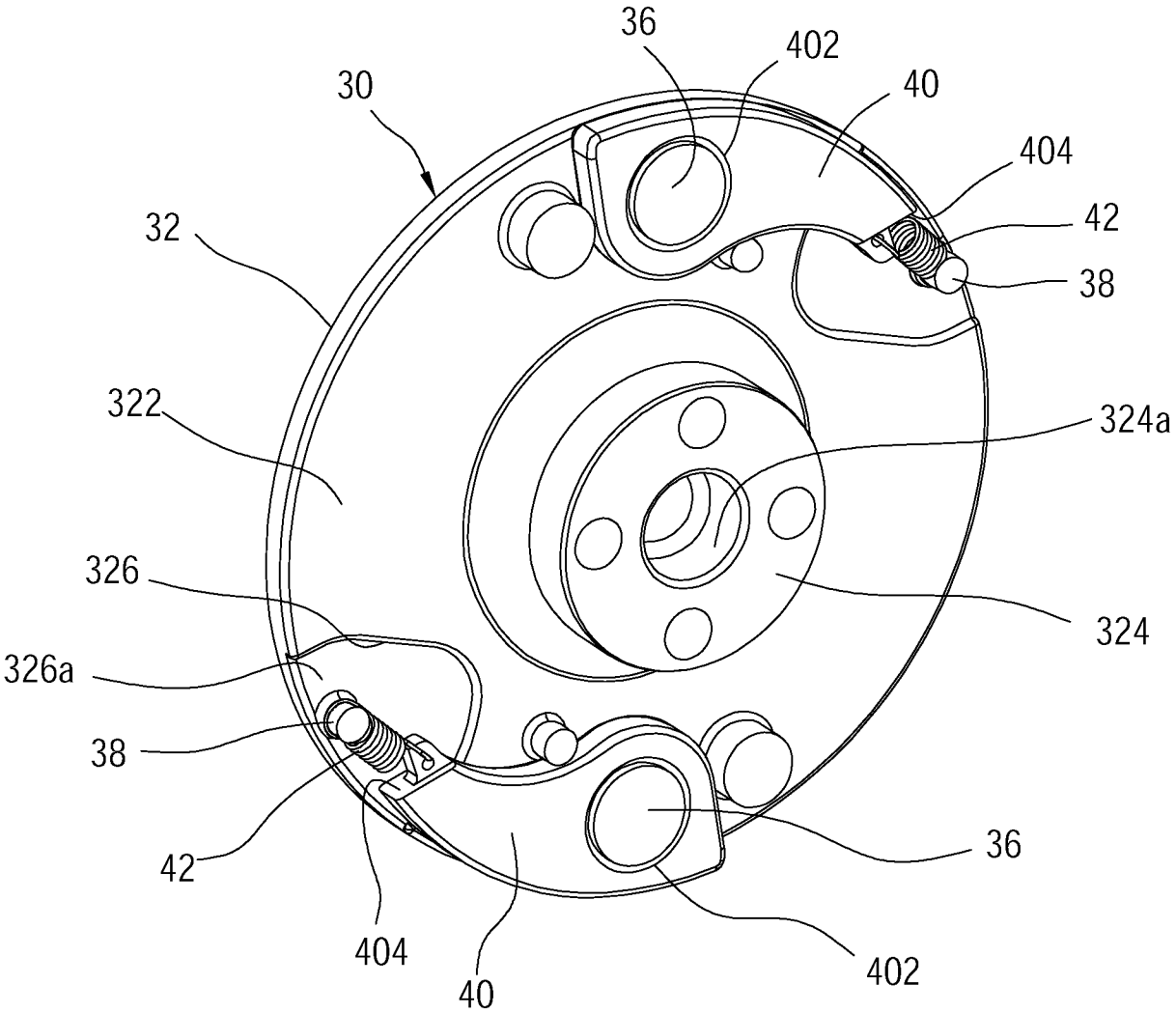
FIG. 4 is a perspective view, showing the brake wheel and the brake blocks of the fall arrest device in accordance with the first embodiment of the present invention.

Referring to FIG. 2 to FIG. 6, a fall arrest device 100 in accordance with a first embodiment of the present invention is shown. As illustrated, the fall arrest device 100 comprises a housing 10, and a bracket 14 a rotating member 24, a safety belt 26, a winding device 28, a brake wheel 30, at least one brake block 40, and at least one restoring spring 42 which are disposed in the housing 10.

Two shells 12 match with each other to form the housing 10, wherein each of the two shells 12 has a first chamber 12*a*, a second chamber 12*b*, and an opening 12*c*. The two shells 12 are connected to each other via the two openings 12*c*. Further, the housing 10 has a top hole 10*a* and a bottom hole (not shown).

The bracket 14 comprises a frame body 16 and a hanging ring 22 which is engaged with a top of the frame body 16. The frame body 16 has a first side panel 18 and a second side panel 20 facing each other. The first side panel 18 is located in the first chambers 12*a* of the two shells 12. The second side panel 20 is located in the second chambers 12*b* of the two shells 12. The first side panel 18 has a perforation 18*a*, and an outer surface 182 facing away from the second side panel 20, wherein at least one stopper 182*a* is disposed on the outer surface 182. In this embodiment, two stoppers 182*a* are disposed on the outer surface 182, and the two stoppers 1182*a* are oppositely disposed with the perforation 18*a* as a center.

The rotating member 24 is rotatably disposed between the first side panel 18 and second side panel 20 of the frame body 16, comprising a shaft 242 and a rotating drum 244. The shaft 242 has two opposite ends thereof respectively passing through the perforation 18*a* of the first side panel 18 of the bracket 14 and the second side panel 20. The rotating drum 244 is disposed on the shaft 242 and rotates coaxially with the shaft 242. A portion of the rotating drum 244 is exposed inside the perforation 18*a*.

The safety belt 26 is wound around the rotating member 24 between the first side panel 18 and second side panel 20. More specifically, an end of the safety belt 26 is connected to and is wound around the rotating drum 244, while another end thereof extends out of the housing 10 through the bottom hole of the housing 10. The safety belt 26 could be pulled to rotate the rotating drum 244 and the shaft 242.

The reeling device 28 is disposed in the second chambers 12*b* of the two shells 12 and is connected to the second side panel 20 of the bracket 14. The reeling device 28 comprises a box 282 and a spiral spring (not shown) located in the box 282. The spiral spring has an inner end thereof connected to the shaft 242 of the rotating member 24, and an outer end thereof connected to the box 282. The spiral spring provides a power of rewind the safety belt 26.

The brake wheel 30 is engaged with the rotating member 24 and rotates with the rotating member 24. In this embodiment, the brake wheel 30 comprises a wheel body 32 which is circular. The wheel body 32 has an inner surface 322 (i.e., the lateral side of the wheel body 32 defined in the present invention). The inner surface 322 faces the outer surface 192 of the first side panel 18. A central portion of the inner surface 322 is convexly formed with a convex shaft 324 passing through the perforation 18*a* of the first side panel 18 and engaged with the rotating drum 244 of the rotating member 24, and the convex shaft 324 has a shaft hole 324*a* which is adapted to be penetrated by the shaft 242. The brake wheel 30 further comprises at least one pivot axle 36 and at least one fixing rod 38. In this embodiment, two pivot axles 36 and two fixing rods 38 are provided. Each pivot axle 36 and each fixing rod 38 are integrally formed by extending from the inner surface 322 of the wheel body 32 as a monolithic unit, and the two pivot axles 36 and the two fixing rods 38 are respectively located on two opposite sides relative to the convex shaft 324.

Figure 5:
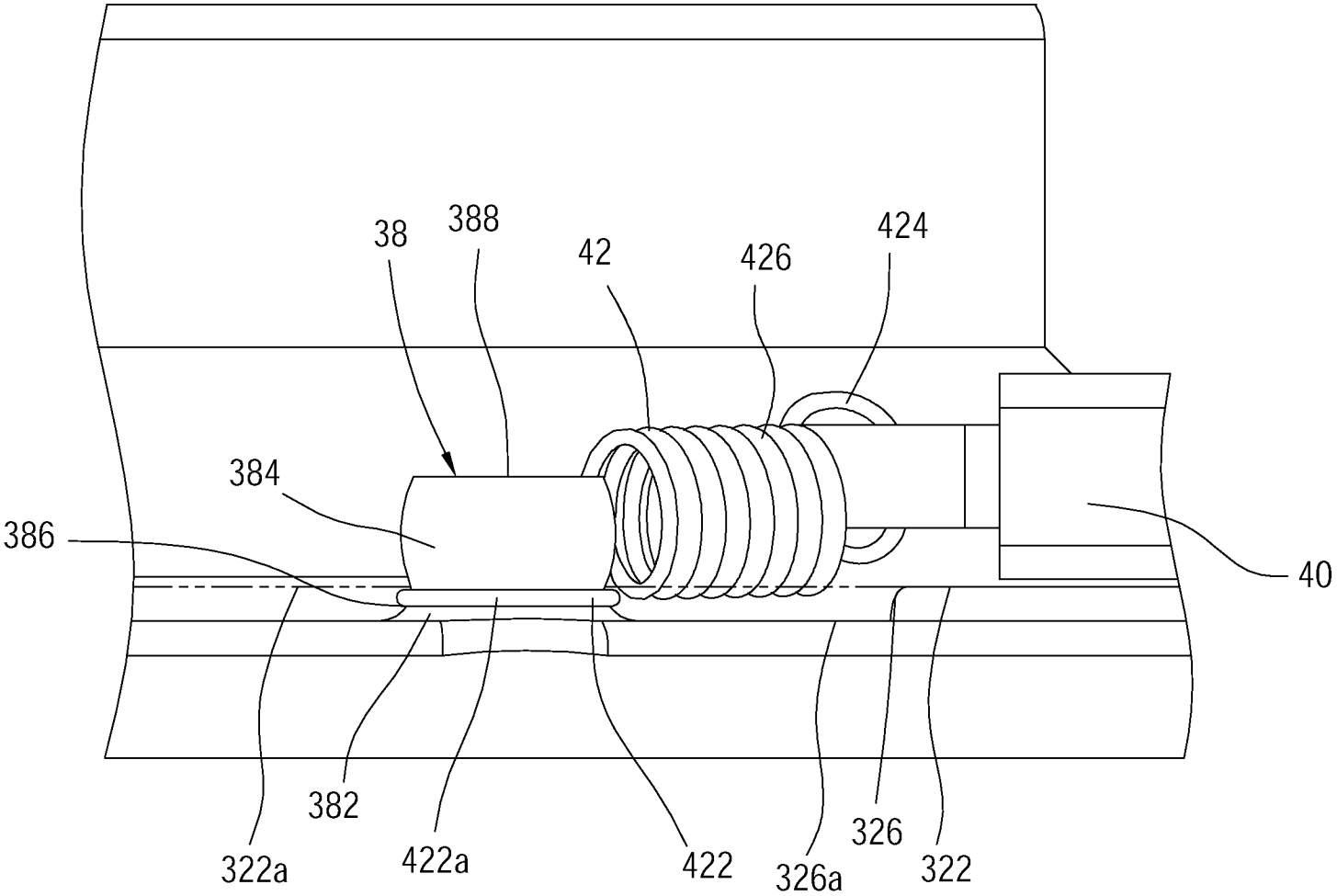
FIG. 5 is a partial side view of FIG. 4.
Figure 6:
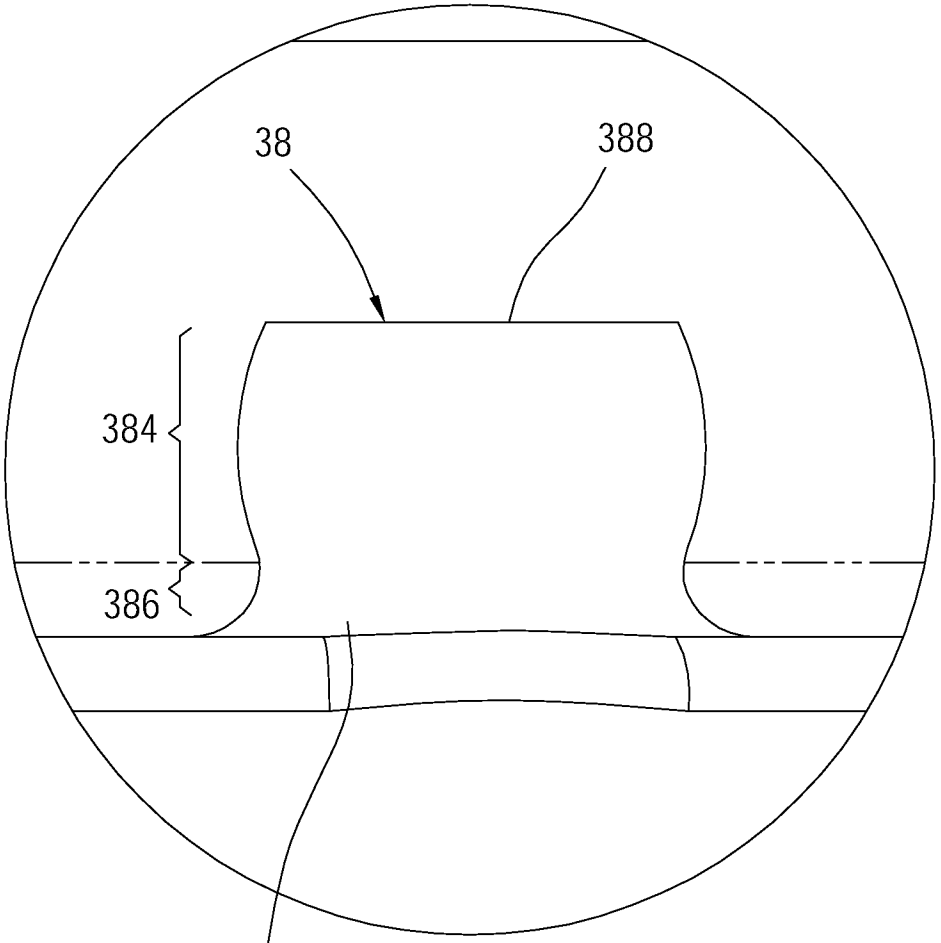
FIG. 6 is a side view, showing the fixing rod in accordance with the first embodiment of the present invention.

The structure of each fixing rod 38 is the same, and one of the fixing rods 38 is taken as an example to illustrate the structure thereof with reference to FIG. 5 and FIG. 6. As illustrated, the fixing rod 38 has a fixed end 382, a first segment 384 and a second segment 386. The fixed end 382 is connected to the wheel body 32. The second segment 386 is located between the fixed end 382 and the first segment 384. An outer diameter of the first segment 384 is greater than an outer diameter of the second segment 386. An outer end of the fixing rod 38 is a free end 388, and the first segment 384 is located between the free end 388 and the second segment 386.

In this embodiment, the inner surface 322 of the wheel body 32 is recessed to form at least one groove 326. In this embodiment, two grooves 326 are formed in the inner surface 322 of the wheel body 32. The fixed end 382 of each fixing rod 38 is connected to a surface 326*a* of one respective groove 326. The second segment 386 of each fixing rod 38 is located between an extension surface 322*a* of the inner surface 322 and the surface 326*a* of the respective groove 326, and each fixing rod 38 protrudes beyond the respective groove 326. The outer diameter of the first segment 384 is gradually increased from the free end 388 toward the second segment 386. In this embodiment, the outer diameter of the first segment 384 is gradually increased to the maximum and then gradually decreased, so that an outer peripheral surface of the first segment 384 is convexly curved. However, the shape of the outer peripheral surface of the first segment is not a limitation of the present invention. In other embodiments, the outer peripheral surface of the first segment could be tapered. Further, a length of the first segment 384 is greater than a length of the second segment 386.

In the current embodiment, the fall arrest device 100 includes two brake blocks 40, wherein each brake block 40 has a pivot hole 402. The brake block 40 is pivotally connected to the pivot axle 36 of the brake wheel 30 via the pivot hole 402, such that the brake block 40 is located in the space between the inner surface 322 of the wheel body 32 of the brake wheel 30 and the outer surface 182 of the first side panel 18. The brake block 40 could be pivoted between a restoring position (refer to FIG. 4) and an extended position. Each brake block 40 has a stop portion 404. The stop portion 404 of the brake block 40 is spun out to the extended position with the centrifugal force generated by the rotation of the brake wheel 30 to abut against the stopper 182*a*, thereby limiting the rotation of the rotating member 24.

The restoring spring 42 has a first end 422 and a second end 424, wherein the first end 422 is connected to the brake wheel 30, and the second end 424 is connected to the brake block 40 to be located at a side of the stop portion 404. In a normal state, each restoring spring 42 urges the corresponding brake block 40 to remain in the restoring position, so that the stop portion 404 of the brake block 40 is normally located in an area of an outer circumference of the wheel body 32 of the brake wheel 30.

More specifically, the first end 422 is circularly curved to form a ring 422*a*, wherein an inner diameter of the ring 422*a* is smaller than the outer diameter of the first segment 384 and is slightly greater than the outer diameter of the second segment 386. The ring 422*a* fits around the second segment 386 of the fixing rod 38. During the process of assembling, the ring 422*a* is placed to the free end 388 of the fixing rod 38 first. Since the ring 422*a* is flexible, when the ring 422*a* is attached to the first segment 384, the ring 422*a* will expand along the outer perimeter of the first segment 384 and then shrink, and finally fits around the second segment 386. The outer diameter of the first segment 384 is gradually increased from the free end 388 to the second segment 386, which facilitates the mounting of the ring 422*a*. The inner diameter of the ring 422*a* is preferably greater than the outer diameter of the free end 388 which facilitates to fit around the fixing rod 38.

Since the inner diameter of the ring 422*a* is smaller than the outer diameter of the first segment 384 of the fixing rod 38, the ring 422*a* could be restricted to the second segment 386, thereby to prevent the ring 422*a* from disengaging from the fixing rod 38.

With the outer diameter of the first segment 384 gradually increased to the maximum and then gradually contracted, when the person wants to remove the ring 422*a* (for example, to replace the restoring spring 42), the ring 422*a* could be stretched by the outer perimeter of the first segment 384, which could be easily taken out of the fixing rod 38. In practice, the outer diameter of the first segment 384 could be gradually increased to the maximum, and could be not shrunk, thereby to form a step difference between the first segment 384 and the second segment 386.

With the length of the first segment 384 greater than the length of the second segment 386, even if the ring 422*a* is removed from the second segment 386 in direction toward the free end 388, the ring 422*a* could be placed over the first segment 384 for a longer distance, reducing the chance of directly disengaging from the fixing rod 38.

Since the second segment 386 of the fixing rod 38 is located between the extension surface 322*a* of the inner surface 322 of the wheel body 32 and the surface 326*a* of the groove 326, the restoring spring 42 could be disposed close to the surface 326*a* of the groove 326 of the brake wheel 30 and the brake block 40 could be disposed close to the inner surface 322 of the brake wheel 30 after the ring 422*a* of the first end 422 is placed onto the second segment 386. The groove 326 could accommodate a part of a body 426 of the restoring spring 42, avoiding the brake block 40 from propping away from the inner surface 322 by the restoring spring 42, which may cause rubbing of the brake block 40 against the first side panel 18.

When the user accidentally falls, the safety belt 26 will be pulled sharply to rotate the rotating member 24 and the brake wheel 30 to rapidly, so that the brake block 40 is subjected to a centrifugal force and overcomes the elastic force of the restoring spring 42 to be spun out. At this time, one of the brake blocks 40 abuts against one of the stoppers 182*a* to restrict the rotation of the rotating member 24 and to fix the pulled out length of the safety belt 26, preventing the user from falling continuously.

Figure 7:
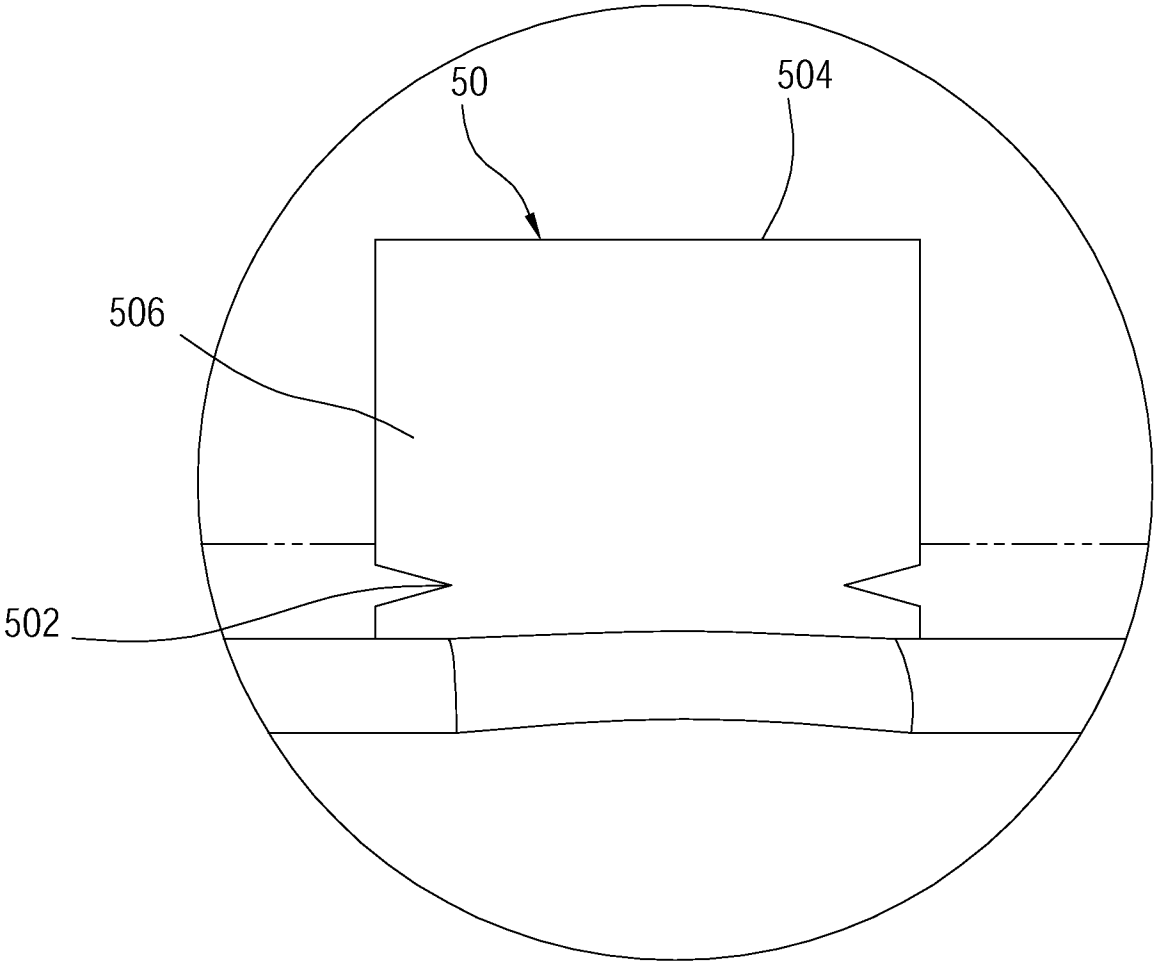
FIG. 7 is a side view, showing the fixing rod of the fall arrest device in accordance with a second embodiment of the present invention.

FIG. 7 illustrates a fixing rod 50 of a fall arrest device in accordance with a second embodiment of the present invention. The fall arrest device according to the second embodiment is substantially similar to that of the first embodiment, except that an outer perimeter of a fixing rod 50 is recessed to form an annular groove 502, wherein the annular groove 502 constitutes a second segment, and a first segment 506 is defined between the annular groove 502 and the free end 504. A first segment 506 has a constant outer diameter.

Figure 8:
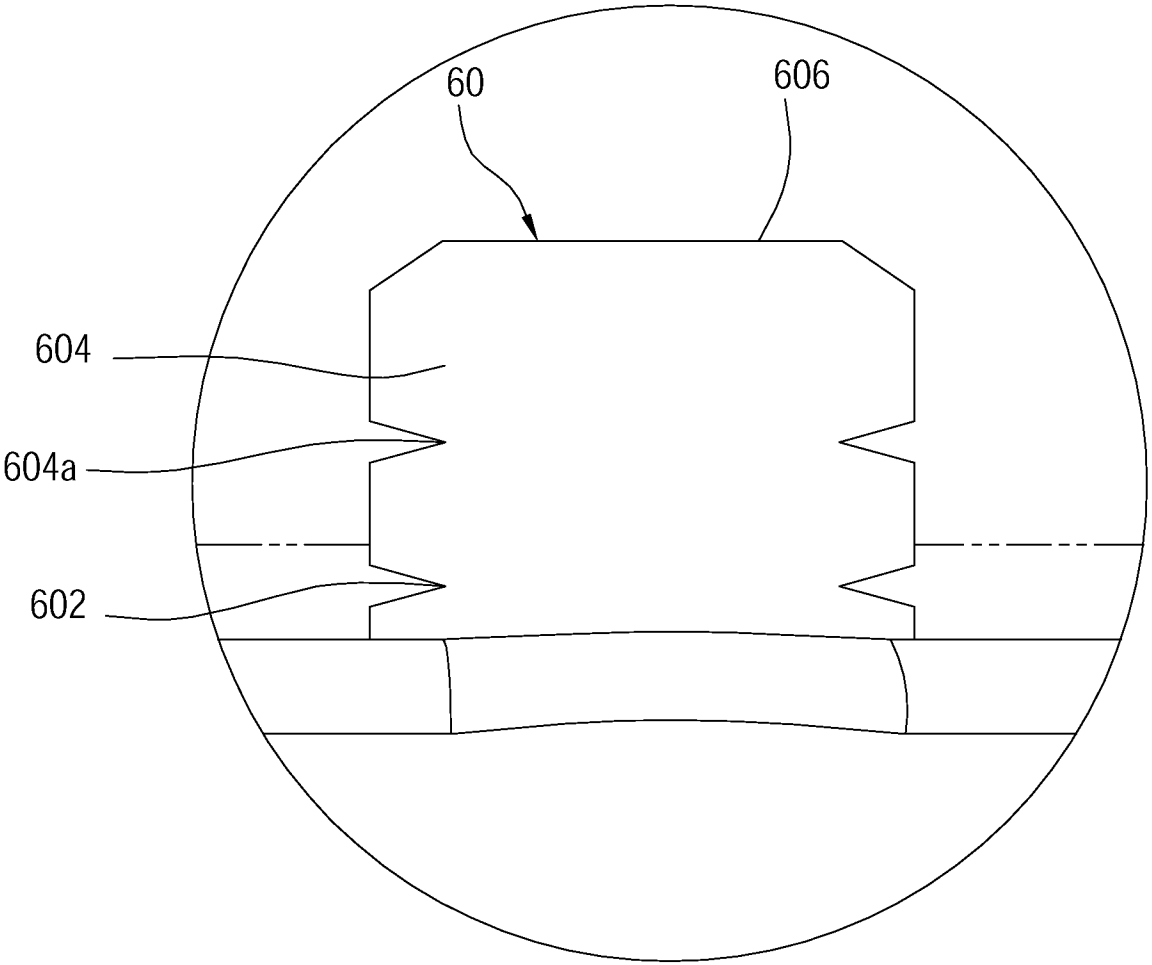
FIG. 8 is a schematic side view, showing the fixing rod of the fall arrest device in accordance with a third embodiment of the present invention.

FIG. 8 illustrates a fixing rod 60 of a fall arrest device in accordance with a third embodiment of the present invention, which is based on the second embodiment, except that a fixing rod 60 has another annular groove 604*a* in addition to an annular groove 602 that forms the second segment. The another annular groove 604*a* is recessed from an outer peripheral surface of a first segment 604. Further, an outer diameter of the first segment 604 from the free end 606 toward the annular groove 602 is tapered first and then be constant. In this way, if the ring of the restoring spring is disengaged from the annular groove 602, the ring could still enter the other annular groove 604*a* of the first segment 604, so that the ring could still be maintained on the fixing rod 60, increasing the reliability of the fall arrest device.

According to the above description, with the outer diameter of the fixing rod being greater than the outer diameter of the second segment, and the outer diameter of the first segment of the fixing rod being greater than the inner diameter of the ring of the restoring spring, the fall arrest device of the present invention could restrict the ring to the second segment, effectively avoiding the restoring spring from falling out of the fixing rod to improve reliability.

It must be pointed out that the embodiments described above are only some preferred embodiments of the present invention. All equivalent structures which employ the concepts disclosed in this specification and the appended claims should fall within the scope of the present invention.

What is claimed is:

1. A fall arrest device, comprising a bracket, a rotating member, a safety belt, a brake wheel, a brake block, and a restoring spring, wherein said bracket has a stopper provided thereon; said rotating member is rotatably disposed on said bracket; said safety belt is wound around said rotating member and is pulled to drive said rotating member to rotate; said brake wheel is connected to and is rotated with said rotating member; said brake block is pivotally disposed on said brake wheel and has a stop portion; said restoring spring has a first end thereof connected to said brake wheel and a second end thereof connected to said brake block; said restoring spring normally drives said brake block to remain in a restoring position; said stop portion of said brake block is spun out with a centrifugal force generated by a rotation of said brake wheel to abut against said stopper so as to limit a rotation of said rotating member; the fall arrest device is characterized in that:

said brake wheel comprises a wheel body and a fixing rod, wherein said wheel body is connected to said rotating member; said fixing rod has a fixed end, a first segment, and a second segment, wherein said fixed end is connected to said wheel body, and said second segment is located between said fixed end and said first segment; an outer diameter of said first segment is greater than an outer diameter of said second segment;

said first end of said restoring spring has a ring, wherein said ring fits around said second segment of said fixing rod, and an inner diameter of said ring is smaller than the outer diameter of said first segment;

wherein a length of said first segment of said fixing rod is greater than a length of said second segment.

2. The fall arrest device as claimed in claim 1, wherein a groove is recessed into a surface of said wheel body; said fixed end of said fixing rod is connected to a surface of said groove; said second segment of said fixing rod is located between a height of said surface of said wheel body and said surface of said groove.

3. The fall arrest device as claimed in claim 1, wherein said fixing rod has a free end; said first segment is located between said free end and said second segment; the outer diameter of said first segment is gradually increased from said free end toward said second segment and then gradually contracted.

4. The fall arrest device as claimed in claim 3, wherein the inner diameter of said ring is greater than an outer diameter of said free end.

5. The fall arrest device as claimed in claim 1, wherein an outer peripheral surface of said first segment is convexly curved.

6. The fall arrest device as claimed in claim 1, wherein said fixing rod has an annular groove recessed into an outer peripheral surface of said fixing rod, and said annular groove constitutes said second segment.

7. The fall arrest device as claimed in claim 6, wherein said fixing rod further has another annular groove recessed into an outer peripheral surface of said first segment.

8. A fall arrest device, comprising a bracket, a rotating member, a safety belt, a brake wheel, a brake block, and a restoring spring, wherein said bracket has a stopper provided thereon; said rotating member is rotatably disposed on said bracket; said safety belt is wound around said rotating member and is pulled to drive said rotating member to rotate; said brake wheel is connected to and is rotated with said rotating member; said brake block is pivotally disposed on said brake wheel and has a stop portion; said restoring spring has a first end thereof connected to said brake wheel and a second end thereof connected to said brake block; said restoring spring normally drives said brake block to remain in a restoring position; said stop portion of said brake block is spun out with a centrifugal force generated by a rotation of said brake wheel to abut against said stopper so as to limit a rotation of said rotating member; the fall arrest device is characterized in that:

said brake wheel comprises a wheel body and a fixing rod, wherein said wheel body is connected to said rotating member; said fixing rod has a fixed end, a first segment, and a second segment, wherein said fixed end is connected to said wheel body, and said second segment is located between said fixed end and said first segment; an outer diameter of said first segment is greater than an outer diameter of said second segment;

said first end of said restoring spring has a ring, wherein said ring fits around said second segment of said fixing rod, and an inner diameter of said ring is smaller than the outer diameter of said first segment, wherein said fixing rod has a free end; said first segment is located between said free end and said second segment; the outer diameter of said first segment is gradually increased from said free end toward said second segment.

9. The fall arrest device as claimed in claim 8, wherein the inner diameter of said ring is greater than an outer diameter of said free end.

10. The fall arrest device as claimed in claim 8, wherein a groove is recessed into a surface of said wheel body; said fixed end of said fixing rod is connected to a surface of said groove; said second segment of said fixing rod is located between a height of said surface of said wheel body and said surface of said groove.

11. The fall arrest device as claimed in claim 8, wherein an outer peripheral surface of said first segment is convexly curved.

12. The fall arrest device as claimed in claim 8, wherein said fixing rod has an annular groove recessed into an outer peripheral surface of said fixing rod, and said annular groove constitutes said second segment.

13. The fall arrest device as claimed in claim 12, wherein said fixing rod further has another annular groove recessed into an outer peripheral surface of said first segment.

* * * * *